US005970927A

United States Patent [19]

Suzuki

[11] Patent Number: 5,970,927

[45] Date of Patent: Oct. 26, 1999

[54] APPARATUS FOR CIRCULATING COOLING WATER FOR INTERNAL COMBUSTION ENGINE

[75] Inventor: Makoto Suzuki, Mishima, Japan

[73] Assignee: Toyota Jidosha Kabushiki Kaisha, Toyota, Japan

[21] Appl. No.: 09/140,503

[22] Filed: Aug. 26, 1998

[30] Foreign Application Priority Data

Sep. 9, 1997 [JP] Japan ..... 9-244319

[51] Int. Cl.[6] ..... F01P 3/18

[52] U.S. Cl. ..... 123/41.29; 123/41.05

[58] Field of Search ..... 123/41.29, 41.02, 123/41.05, 41.31, 142.5 R, 41.01, 196 AB; 237/12.3 B

[56] References Cited

U.S. PATENT DOCUMENTS

| | | | |
|---|---|---|---|
| 2,576,757 | 11/1951 | Heymann | 237/12.3 B |
| 3,851,629 | 12/1974 | Mayr et al. | 123/41.08 |
| 3,921,600 | 11/1975 | Henning et al. | 237/12.3 B |
| 4,049,047 | 9/1977 | Keen | 123/41.29 |
| 4,697,551 | 10/1987 | Larsen et al. | 123/41.31 |
| 5,337,704 | 8/1994 | Roth | 123/41.29 |
| 5,419,287 | 5/1995 | Evans | 123/41.29 |
| 5,497,734 | 3/1996 | Okada | 123/41.29 |
| 5,503,117 | 4/1996 | Saito | 123/41.01 |

*Primary Examiner*—Noah P. Kamen
*Assistant Examiner*—Jason Benton
*Attorney, Agent, or Firm*—Kenyon & Kenyon

[57] ABSTRACT

An apparatus for circulating cooling water for an internal combustion engine has a cooling water outer passageway, through which an engine body, a radiator, an indoor heater core and an oil cooler communicate with each other, for flowing the cooling water therethrough. The cooling water outer passageway includes a gong-to-engine-body communicating passageway through which the cooling water flows from the radiator towards the engine body, a going-to-heater-core communicating passageway through which the cooling water flows from the engine body towards the indoor heater core, and an oil cooler cooling water communicating passageway, bypasses the engine body communicating passageway and the heater core communicating passageway with respect to a water jacket, including an oil cooler midways of this oil cooler cooling water communicating passageway. The engine body communicating passageway and the heater core communicating passageway provided with flow rate control valves for reducing a quantity of the cooling water when a temperature of the cooling water comes to a predetermined temperature. A connecting point between the oil cooler cooling water communicating passageway and the heater core communicating passageway, exists more upstream than a point M at which the flow rate control valve is disposed on the heater core communicating passageway.

5 Claims, 3 Drawing Sheets

APPARATUS FOR CIRCULATING COOLING WATER FOR INTERNAL COMBUSTION ENGINE

BACKGROUND OF THE INVENTION

1. Field of the Invention

The present invention relates to an apparatus for circulating cooling water for an internal combustion engine.

2. Related Background Art

A cooling water circulating apparatus for an internal combustion engine is constructed to absorb, with cooling water, heat emitted from a body of the internal combustion engine and utilize some proportion of the absorbed heat as a thermal source for an indoor heater for heating an interior of a vehicle room.

A construction for this purpose is that the cooling water flows an intra-engine cooling water passageway, i.e., a so-called water jacket formed within the body of the internal combustion engine, during which the cooling water becomes hot by absorbing the heat from the body of the internal combustion engine, and flows to the indoor heater from the body if the internal combustion engine via a heater cooling water passageway through which the body of the internal combustion engine is connected to the indoor heater.

Immediately after starting up the internal combustion engine, however, the cooling water is not sufficiently heated, and hence the indoor heater does not work well.

Under such circumstances, for example, Japanese Patent Application Laid-Open Publication No.59-119010 discloses a technology for providing a flow rate control valve capable of controlling a flow rate of the cooling water flowing down to the indoor heater in accordance with a temperature of the cooling water. According to this technology, when the temperature of the cooling water is low, the flow rate of the cooling water is reduced by throttling down the flow of the cooling water, thereby increasing the temperature of the cooling water. Therefore, a start-up velocity of the indoor heater can be increased even when actuating the internal combustion engine.

In a high-performance internal combustion engine, however, a lubricating oil with its temperature increased by actuating the internal combustion engine is cooled off by an oil cooler, and a cooling source thereof involves the use of the cooling water.

The oil cooler utilizing the cooling water as a cooling source is known as a water cooling type oil cooler. The water cooling type oil cooler is hereinafter simply termed an "oil cooler". Then, an oil cooler cooling water communicating passageway for supplying and discharging the cooling water to and from the oil cooler, is formed separately from the heater cooling water passageway for connecting the internal combustion engine body to the indoor heater.

On the other hand, the cooling water flowing to both of the oil cooler and the indoor heater is circulated by a water pump and, after flowing to the oil cooler and the indoor heater, flows back to the same water pump.

Then, the technologies contrived so far take such a structure that a large quantity of cooling water flows toward the oil cooler cooling water passageway even just after actuating the internal combustion engine not enough to be heated up. Further, the oil is still in a cool state of not being sufficiently heated up just after the internal combustion engine has been actuated. Hence, when the large quantity of cooling water assuming a small quantity of heat is flowed to such an oil, the heat held by the cooling water is absorbed by the oil. This is because the temperature of the lubricating oil is always, as shown in FIG. 3, lower than that of the cooling water immediately after actuating the engine.

Therefore, the temperature of the cooling water is absorbed by the lubricating oil, and it takes comparatively much time to increase the temperature of the cooling water. Therefore, the heater does not well start up, and warming-up is promoted with a difficulty.

SUMMARY OF THE INVENTION

It is a primary object of the present invention contrived under such circumstances to provide an apparatus for circulating cooling water for an internal combustion engine, which is capable of speeding up a start-up of a heater when actuating even an internal combustion engine incorporating an oil cooler and besides sufficiently promoting warming-up.

To accomplish the above object, according to one aspect of the present invention, an apparatus for circulating cooling water for an internal combustion engine comprises an internal combustion engine body having a cooling water inner passageway for cooling off a peripheral portion of a cylinder, a radiator for radiating, into the atmosphere, heat of the internal combustion engine body which is absorbed by the cooling water, a heater for using some proportion of the cooling water as a thermal medium, an oil cooler for cooling off a lubricating oil of the internal combustion engine body with the cooling water serving as a coolant, and a communicating passageway, through which the internal combustion engine body, the radiator, the heater and the oil cooler communicate with each other, for flowing the cooling water between these constructive members, whereby the cooling water is circulated via the communicating passageway between the radiator and the internal combustion engine body and between the heater and the internal combustion engine body. The thus constructed cooling water circulating apparatus takes a configuration which follows.

That is, the communicating passageway includes a radiator-side cooling water communicating passageway through which the cooling water flows from the radiator towards the internal combustion engine body, a heater-side cooling water communicating passageway through which the cooling water flows from the internal combustion engine body towards the heater, and an oil cooler cooling water communicating passageway, from which the heater-side cooling water communicating passageway and the radiator-side cooling water communicating passageway are bypassed, including the oil cooler midways of the oil cooler cooling water communicating passageway. The heater-side cooling water communicating passageway and the radiator-side cooling water communicating passageway are each provided with a flow rate control valve for reducing a quantity of the cooling water flowing each of the passageways when a temperature of the cooling water is under a predetermined value. A connecting point between the oil cooler cooling water communicating passageway and the heater-side cooling water communicating passageway exists more upstream than a point at which the flow rate control valve is disposed on the heater-side cooling water communicating passageway.

Herein, the flow rate control valve is a thermostat or a thermostat type flow rate control valve that does not open until the temperature of the cooling water comes to a predetermined temperature. When the cooling water becomes warmer as the flow rate control valve opens larger, the cooling water is circulated between the radiator and the internal combustion engine body and between the heater and the internal combustion engine body. When the cooling water becomes cooler as the flow rate control valve is closed more tightly, the cooling water is not circulated. This flow rate control valve should not, however, be structured so that the cooling water does not flow at all even in the valve-closed state but is preferably structured so that there flows a very small amount of cooling water enough to be perceptive of how much a temperature of the cooling water may be, i.e., for a thermalsensitive use.

Further, in comparison between the flow rate control valve provided on the radiator-side cooling water communicating passageway and the flow rate control valve provided on the heater-core-side cooling water communicating passageway, the flow rate control valve provided on the radiator-side cooling water communicating passageway is higher in terms of the valve opening temperature and therefore opens in the vicinity of 80° C. By contrast, it is desired that the valve opening temperature of the flow rate control valve provided on the heater-side cooling water communicating passageway be in the vicinity of 45° C. enough to make a driver feel warm upon receiving the air blown from the heater. Note that the "vicinity" herein implies in terminology a range of ±5° C. and this range allowed for may differ depending on types of the internal combustion engine and of the car to be used.

Then, the radiator-side cooling water communicating passageway and the heater-side cooling water communicating passageway are bypassed by the oil cooler cooling water communicating passageway including the oil cooler midways of this passageway with respect to the cooling water inner passageway of the internal combustion engine body. A connecting point between the oil cooler cooling water communicating passageway and the heater-side cooling water communicating passageway exists more upstream than a point at which the flow rate control valve is disposed on the heater-side cooling water communicating passageway. Hence, when the cooling water is led into the oil cooler cooling water communicating passageway from the radiator-side cooling water communicating passageway, this led-in cooling water is discharged more upstream than the point at which the flow rate control valve is disposed on the heater-side cooling water communicating passageway.

Accordingly, when the temperature of the cooling water is lower than the predetermined temperature defined as the valve opening temperature of the flow rate control valve provided on the heater-side cooling water communicating passageway, there are closed not only the flow rate control valve provided on the heater-side cooling water communicating passageway but also the flow rate control valve provided on the radiator-side cooling water communicating passageway which has a higher valve opening temperature of that of the flow rate control valve provided on the heater-side cooling water communicating passageway. Therefore, the cooling water does not flow and comes into a blocked state with the exception of a very small amount of cooling water flowing for the thermalsensitive use. Hence, the oil cooler cooling water communicating passageway communicating with the heater-side cooling water communicating passageway is under the same condition, wherein there is no flow of the cooling water through the oil cooler cooling water communicating passageway, and the cooling water stagnates. As a result, the heat becomes dificult to propagate from the cooling water toward the oil cooler, and therefore the heat held by the cooling water is not absorbed by the lubricating oil. Accordingly, a rise in the temperature of the whole cooling water in the internal combustion engine is speeded up that much, and hence the heater starts up quickly when actuated, and besides the warming-up can be also sufficiently promoted.

Further, when the flow rate control valve provided on the heater-side cooling water communicating passageway is opened, the cooling water is circulated between the internal combustion engine body and the heater. Then, a specified passageway for flowing the cooling water toward the internal combustion engine body is connected, more downstream than the point at which the flow rate control valve is disposed on the radiator-side cooling water communicating passageway, to somewhere on this radiator-side cooling water communicating passageway. With this contrivance, it never happens that the flow of the cooling water flowing from the specified passageway is hindered by the flow rate control valve on the radiator-side cooling water communicating passageway. Hence, it follows that the cooling water flows also int the oil cooler cooling water communicating passageway for connecting the radiator-side cooling water communicating passageway to the heater-side cooling water communicating passageway. Accordingly, the lubricating oil possessed by the oil cooler included in the oil cooler cooling water communicating passageway, is cooled off.

Further, when the cooling water comes to have a temperature enough to make the drive feel warm, the flow rate control valve on the heater-side cooling water communicating passageway opens, and therefore the temperature of the cooling water at that time suffices for working the heater. For this reason, it never happens that the effectiveness of the heater declines due to the fact that the lubricating oil is cooled by the cooling water.

Then, if the temperature of the cooling water becomes higher as the flow rate control valve provided on the radiator-side cooling water communicating passageway opens larger, the cooling water is circulated between the radiator and the internal combustion engine body, and the temperature of the cooling water is controlled to a temperature proper to an operating state of the internal combustion engine.

DESCRIPTION OF THE PREFERRED EMBODIMENT

An embodiment of the present invention will hereinafter be discussed with reference to the accompanying drawings.

Figure 1:
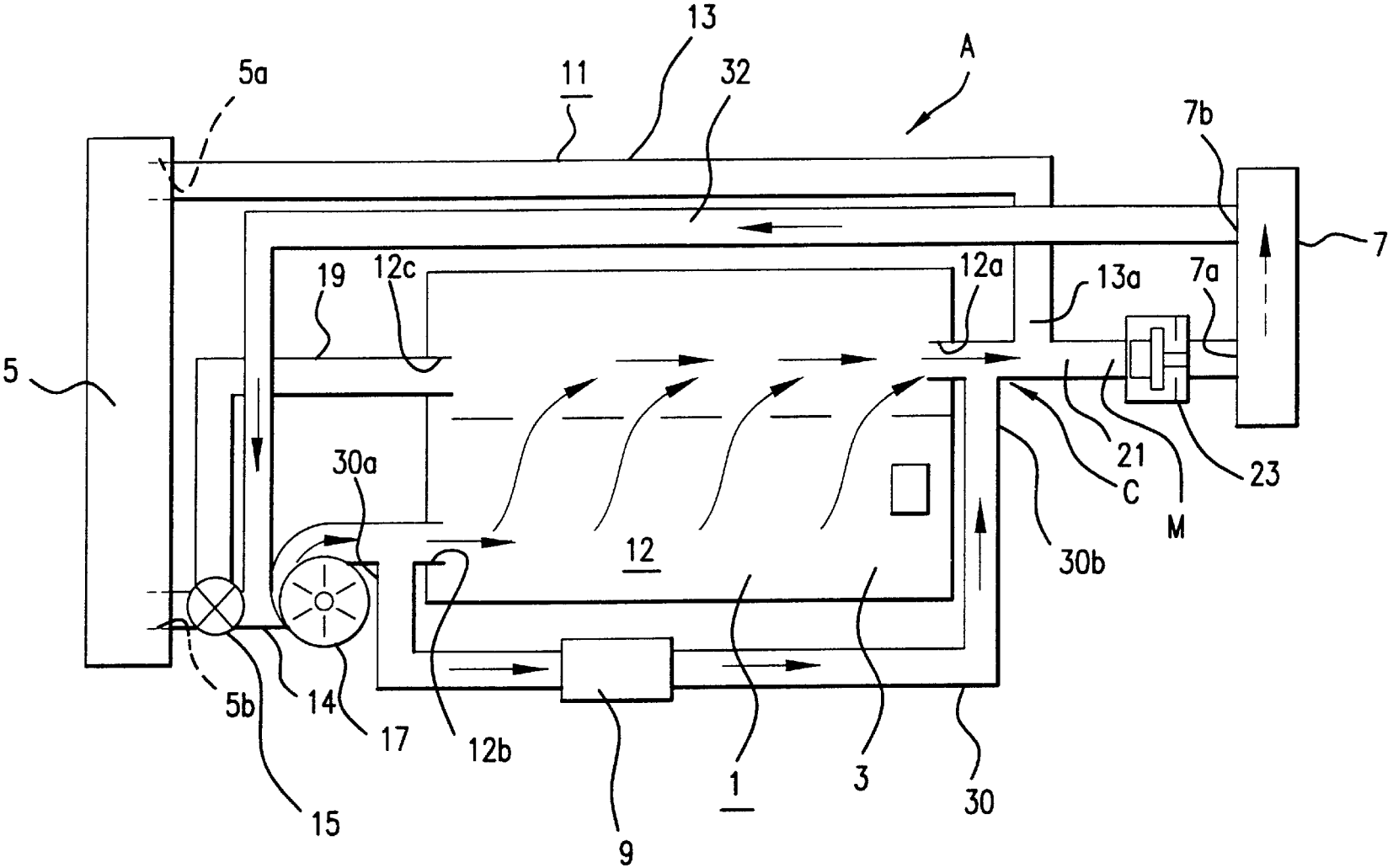
FIG. 1 is a schematic diagram illustrating a cooling water circulating apparatus for an internal combustion engine according to the present invention.

As shown in FIG. 1, an engine (an internal combustion engine) 1 includes a radiator 5 disposed on the left side of an engine body 3 and an indoor heater core 7 disposed on the right side thereof. The engine 1 also includes an oil cooler 9 disposed downwardly. The radiator 5, the heater core 7 and the oil cooler 9 are, with the engine body 3 being centered, connected to each other via a cooling water outer passageway (a communication passageway) 11. The cooling water outer passageway 11 is constructed of fragmentary passageways 13, 14, 19, 21, 30, 32 which will hereinafter explained in sequence.

The engine body 3 (the internal combustion body) 3 is kept at a high temperature in accordance with an operating state of the engine 1 by making the unillustrated cooling water absorb an intense heat evolved by the engine 1 being actuated. Therefore, an interior of the engine body 3 is formed with a well-known water jacket (a cooling water inner passageway) 12 through which the cooling water passes.

The radiator 5, when the cooling water absorbs the heat emitted from the engine body 3 during its passing through the water jacket 12, radiates into the atmosphere the heat out of the cooling water holding this heat.

The indoor heater core 7 uses, as a thermal medium, some proportion of the cooling water having absorbed the heat emitted from the engine body 3, and makes the hot air blown into the car room.

The oil cooler 9 cools off the lubricating oil contained in the engine 1 with the cooling water serving as a coolant.

The cooling water outer passageway 11, as already explained, through which the engine body 3, the radiator 5, the indoor heater core 7 and the coil cooler 9 communicate with each other, serves to supply these components with the cooling water.

The communicating passageway 13 defined as a part of the cooling water outer passageway 11 is disposed upwardly of the engine body 3. Then, this communicating passageway 13, through which a heater-side aperture 12*a* opened on the side of the heater core 7 is connected to a radiator inlet 5*a* formed in an upper portion of the radiator 5 and through which the cooling water flows from the engine body 3 to the radiator 5, is therefore called a going-to-radiator communicating passageway 13.

The radiator communicating passageway 14 is a passageway through which to flow the cooling water assuming the heat absorbed from the engine body 3 during its passing through the water jacket 12.

Further, the communicating passageway 14 defined as another part of the cooling water outer passageway 11 is disposed downward in FIG. 1 between the radiator 5 and the engine body 3. Then, this communicating passageway 14, through which a radiator-side outlet 5*b* is connected to a radiator-side aperture 12*b* opened on the side of the radiator, serves to flow the cooling water to the side of the engine body 3 from the radiator 5. Hence, the communicating passageway 14 is referred to as a going-to-engine-body communicating passageway (a radiator-side cooling water passageway) 14. The engine body communicating passageway 14 is provided midways of this passageway with a flow rate control valve (a thermostat) 15 and a water pump 17 sequentially from the radiator 5.

The flow rate control valve 15 is disposed on the side of the radiator 5 in the engine 1 and therefore called the radiator-side flow rate control valve 15. The radiator-side flow rate control valve 15 opens when the cooling water is at a temperature of 82° C. or higher and closes when at lower temperatures than 82° C.

The water pump 17 pumps the cooling water throughout the cooling water passageway 11.

Further, the communicating passageway 19 taking in an L-shape and defined as still another part of the cooling water outer passageway 11 extend between the radiator-side flow rate control valve 15 and the radiator-side aperture 12*c* disposed upwards in the opening of the water jacket 12 opening on the side of the radiator 5 of the engine body 3.

The communicating passageway 19 is a bypass passageway provided for preventing the engine body 3 from being damaged by pressure. Hence, the communicating passageway 19 is hereinafter termed pressure-damage preventing bypass passageway 19.

Figure 2:
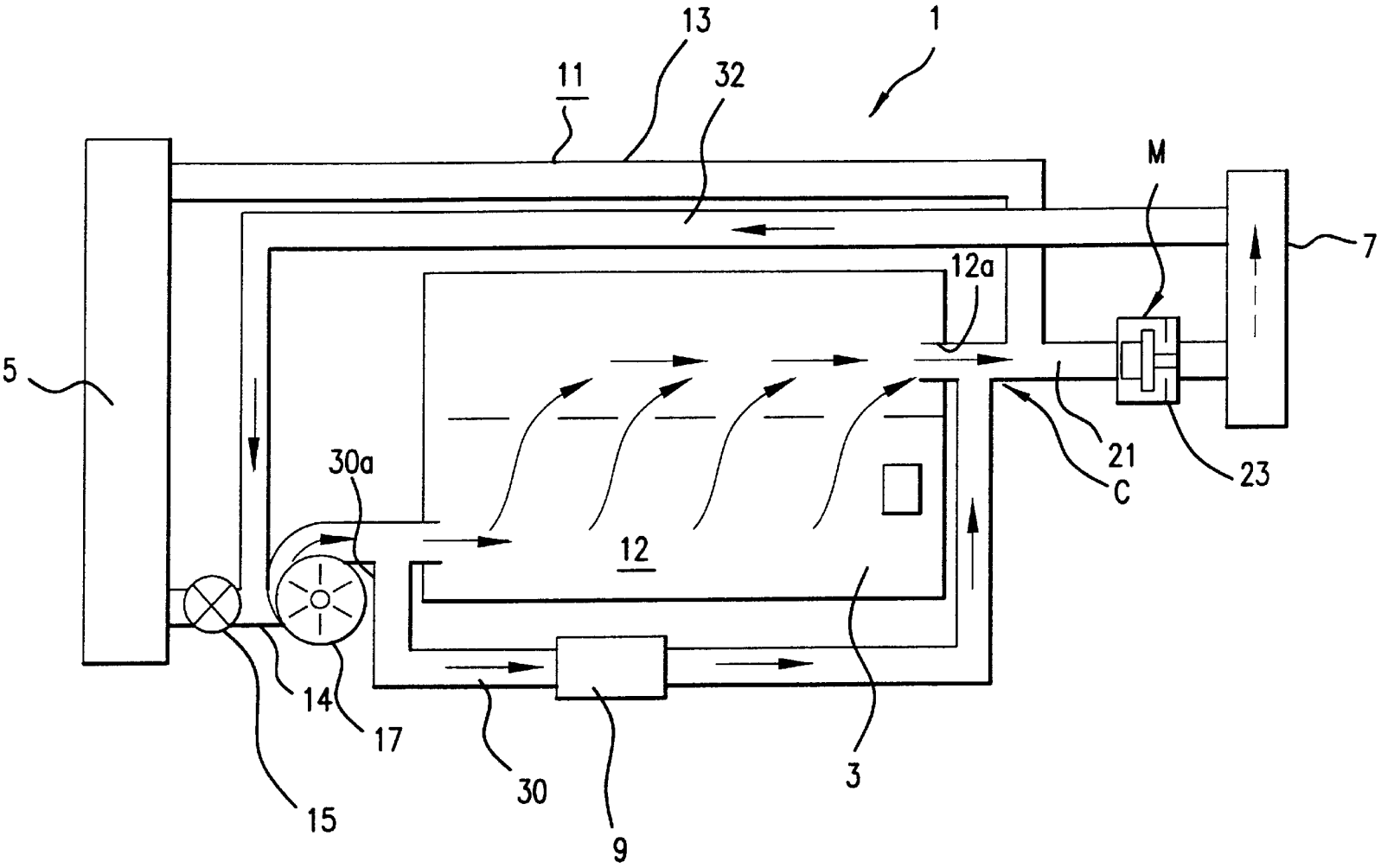
FIG. 2 is a diagram showing a modified example of FIG. 1.
Figure 3:
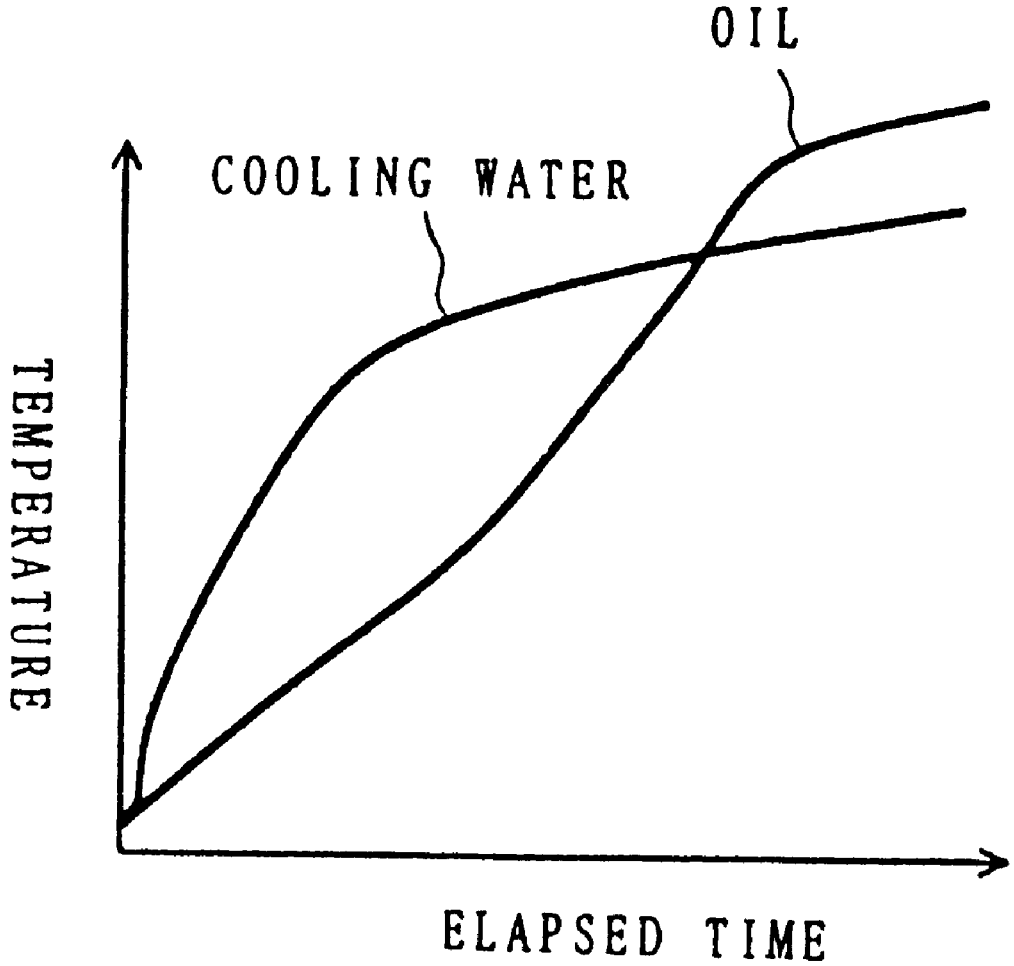
FIG. 3 is a graph a relationship between cooling water and a lubricating oil, showing how temperatures thereof rise.

In the case of the engine with a less pressure damage, the pressure-damage preventing bypass passageway 19 may not be structure as shown in FIG. 2.

Moreover, a communicating passageway designated by the numeral 21, which extends between the heater core 7 and the engine body 3 on the right side in FIG. 1, is also defined as a part of the cooling water outer passageway 11 and extends straight towards an inlet 7*a* of the indoor heater core 7 from the heater-side aperture 12*a* of the water jacket 12. This communicating passageway 21, through which the cooling water flows towards the heater core 7 from the engine body 3, is therefore called a going-to-heater-core communicating passageway (the heater-side cooling water communicating passageway) 21.

A thermostat type flow rate control valve 23 is disposed substantially at a mid-portion M of the heater-core communicating passageway 21. Hence, the mid-portion M is referred to as a disposition point of the flow rate control valve 23.

The flow rate control valve 23 is disposed on the side of the heater core 7 in the engine 1 and hence called the heater-core-side flow rate control valve 23 in order to distinguish it from the radiator-side flow rate control valve 15.

The radiator-side flow rate control valve 15 and the heater-core-side flow rate control valve 23 takes the known structures, and hence the explanations thereof are omitted.

The heater-core-side flow rate control valve 23 opens to flow the cooling water when the temperature of the cooling water is lower than that of the radiator-side flow rate control valve 15, i.e., when at a temperature higher than, e.g., 45° C., and closes to block the cooling water when the temperature of the cooling water is 45° C. or under. Note that the cooling water does not completely flow even when both of the radiator-side flow rate control valve 15 and the heater-core-side flow rate control valve 23 are closed, but a small amount of cooling water flows via unillustrated thermalsensitive small holes even when the valves are closed. Therefore, to give a more accurate description, the heater-core-side flow rate control valve 23, it can be said, reduces a quantity of the cooling water flowing through the heater core communicating passageway 21 when the temperature of the cooling water is 45° C. or under. At the heater-core-side flow rate control valve 23, the cooling water of, e.g., 0.5 liter/min flows. Note that 45° C., a numeral value of temperature, is hot enough to make a person feel warm when receiving the air blown out of the heater.

Further, the engine body communicating passageway 14 communicates via an oil cooler cooling water communicating passageway 30 including the oil cooler 9 with the heater core communicating passageway 21. This oil cooler cooling water communicating passageway 30 is also a fragmentary passageway constituting the cooling water outer passageway 11.

A radiator-side end 30*a* of the oil cooler cooling water communicating passageway 30 is connected to a downstream-side portion of the water pump 17 along the engine body communicating passageway 14. Furthermore, a heater-core-side end 30*b* of the coil cooler cooling water communicating passageway 30 is connected to a connecting point C existing more upstream than the inlet 13*a* of the radiator communicating passageway 13 as well as than the heater-core-side flow rate control valve 23 along the heater core communicating passageway 21.

It is to be noted that the oil cooler cooling water communicating passageway 30 in this embodiment is shown as being provided outside the engine body 3 by way of a part of the cooling water outer passageway 11, but may be provided within the engine body 3 separately from the water jacket 12.

Moreover, a communicating passageway 32 serving as another communicating passageway constituting the cooling water outer passageway 11, is disposed between the engine body 3 and the radiator communicating passageway 13.

The communicating passageway 32 is a passageway, through which the outlet 7*b* of the indoor heater core 7 is connected to the engine body communicating passageway 14, for circulating the cooling water having entered the heater core 7. Further, a connecting point of the communicating passageway 32 to the engine body communicating passageway 14 exists between the radiator-side flow rate control valve 15 and the water pump 17.

Then, the cooling water can be circulated between the radiator 5 and the engine body 3 and between the indoor heater core 7 and the engine body 3 through the respective communicating passageways 13, 14, 19, 21, 30, 32.

What is thus constructed is a cooling water circulating apparatus A for the internal combustion engine in the embodiment of the present invention.

In the thus constructed cooling water circulating apparatus A for the internal combustion engine, between the radiator 5 and the engine body 3, the cooling water coming out of the engine body 3, immediately after entering the heater core communicating passageway 21, flows into the communicating passageway 13 and thereafter arrives at the radiator 5. Then, when the radiator-side flow rate control valve 15 opens, the cooling water flows back to the engine body 3 via the engine body communicating passageway 14. When the radiator-side flow rate control valve 15 is closed, the cooling water does not flow.

Note that the engine body communicating passageway 14 communicates also with the coil cooler cooling water communicating passageway 30 and hence, when the radiator-side flow rate control valve opens, the cooling water is permitted to flow to also the oil cooler cooling water communicating passageway 30.

Further, between the indoor heater core 7 and the engine body 3, the cooling water coming out of the engine body 3, flows into the heater core communicating passageway 21, thereafter, when the heater-core-side flow rate control valve 23 opens, flows therethrough and arrives at the indoor heater core 7. When the heater-core-side flow rate control valve 23 is closed, the cooling water does not flow.

The cooling water, if through the heater core communicating passageway 21, flows via the communicating passageway 32 connecting the heater core 7 to the engine body communicating passageway 14 to the engine body communicating passageway 14, and flows via this engine body communicating passageway 14 back to the engine body 3. Even in this case, the cooling water can flow to the oil cooler cooling water communicating passageway 30 via the engine body communicating passageway 14.

The cooling water led into the oil cooler cooling water communicating passageway 30 is discharged at a more upstream portion than the flow rate control valve 23 along the heater core communicating passageway 21.

Next, an operation and an effect of the cooling water circulating apparatus A for the internal combustion engine are explained.

In the cooling water circulating apparatus A for the internal combustion engine, in comparison between the radiator-side flow rate control valve 15 and the heater-core-side flow rate control valve 23, the former valve 15 has a higher valve opening temperature, i.e., opens at a temperature of 82° C. or greater, and the latter valve 23 opens at a temperature of 45° C. high enough to make the blown from the heater.

Then, the engine body communicating passageway 14 through which the cooling water flows from the radiator to the engine body 3, and the heater core communicating passageway 21 through which the cooling water flows from the engine body 3 to the indoor heater core 7, communicate with the coil cooler cooling water communicating passageway 30 including the oil cooler 9. The cooling water flows into the oil cooler cooling water communicating passageway 30 from the engine body communicating passageway 14, and is discharged at the more upstream portion than at least the heater-core-side control valve 23 along the heater core communicating passageway 21.

Accordingly, when the temperature of the cooling water is lower than 45° C. defined as the valve opening temperature of the heater-core-side flow rate control valve 23 provided on the heater core communicating passageway 21, both of the flow rate control valves 15, 23 are opened, and hence the cooling water does not flow and comes into the blocked state with the exception of a small amount of cooling water flowing for the thermalsensitive use through the cooling water circulating apparatus A of the internal combustion engine. Accordingly, there is no flow of the cooling water through the oil cooler cooling water communicating passageway 30 (which is to be treated as explained in this way for convenience although the cooling water actually flows somewhat for the thermalsensitive use), and the cooling water stagnates there. As a result, at the starting time when the lubricating oil still assumes a lower temperature than the cooling water temperature, there substantially does not occur a thermal propagation between the lubricating oil and the cooling water, and therefore the heat held by the cooling water is not absorbed by the lubricating oil. Accordingly, a start-up velocity of the indoor heater core 7 is high when actuating the engine 1, and besides the warming-up can be well promoted.

Further, with an advancement of the warming-up, when the temperature of the cooling water rises as the heater-core-side flow rate control valve 23 provided on the heater core communicating passageway 21 opens, the cooling water is circulated between the engine body 3 and the indoor heater core 7. Then, the communicating passageway 32 through which the cooling water flows to the engine body 3 from the heater core 7, is connected to a downstream side of the radiator-side flow rate control valve 15 on the engine body communicating passageway 14, and hence, irrespective of whether the radiator-side flow rate control valve 15 is opened or closed, the cooling water flows through the oil cooler cooling water communicating passageway 30 for connecting the engine body communicating passageway 14 to the heater core communicating passageway 21. Hence, the heat held by the lubricating oil is propagated to the cooling water, thus fooling off the lubricating oil. At that time, however, the internal combustion engine is not already in the process of its being actuated, and the heater sufficiently works with an increased temperature of the cooling water. Therefore, even when the heat held by the cooling water is propagated to the lubricating oil, it never happens that the hot air is not blown out of the heater core 7 due to the above thermal propagation.

Then, if the cooling water has a much higher temperature enough to open the radiator-side flow rate control valve 15 provided on the engine body communicating passageway 14, the cooling water is circulated between the radiator 5 and the engine body 3, and the temperature of the cooling water is controlled to a temperature proper to the operating state of the engine 1.

As discussed above, the cooling water circulating apparatus for the internal combustion engine according to the present invention includes the communicating passageway, through which the internal combustion engine body, the radiator, the heater and the oil cooler communicate with each other, for flowing the cooling water between these constructive members. This communicating passageway comprises the radiator-side cooling water communicating passageway through which the cooling water flows from the radiator toward the internal combustion engine body, the heater-side cooling water communicating passageway through which the cooling water flows from the internal combustion engine body toward the heater, and the oil cooler cooling water communicating passageway, bypasses the heater-side cooling water communicating passageway and the radiator-side cooling water communicating passageway, including the oil cooler midways of this passageway. The heater-side cooling water communicating passageway and the radiator-side cooling water communicating passageway are provided with the flow rate control valve for reducing the quantity of the cooling water flowing through these passageways when the temperature of the cooling water is under the predetermined value. The connecting point between the oil cooler cooling water communicating passageway and the heater-side cooling water communicating passageway, exists more stream than the point at which the flow rate control valve on the heater-side cooling water communicating passageway is disposed. With this characteristic construction, the heater starts up quickly when the internal combustion engine is actuated, and besides the warming-up can be well promoted.

What is claimed is:

1. An apparatus for circulating cooling water for an internal combustion engine, comprising:

an internal combustion engine body having a cooling water inner passageway disposed around a cylinder for flowing the cooling water therethrough;

a radiator for radiating, into the atmosphere, heat of said internal combustion engine body which is absorbed by the cooling water;

a heater for using some proportion of the cooling water as a thermal medium;

an oil cooler for cooling off a lubricating oil of said internal combustion engine body with the cooling water serving as a coolant; and a communicating passageway, through which said internal combustion engine body, said radiator, said heater and said oil cooler communicate with each other, for flowing the cooling water between said constructive members, the cooling water being circulated via said communicating passageway between said radiator and said internal combustion engine body and between said heater and said internal combustion engine body, wherein said communicating passageway includes a radiator-side cooling water communicating passageway through which the cooling water flows from said radiator towards said internal combustion engine body;

a heater-side cooling water communicating passageway through which the cooling water flows from said internal combustion engine body towards said heater; and an oil cooler cooling water communicating passageway which includes said oil cooler and connects the heater-side cooling water passageway and the radiator-side cooling water communicating passageway in bypass to the cooling water inner passageway, wherein said heater-side cooling water communicating passageway and said radiator-side cooling water communicating passageway are each provided with a flow rate control valve for reducing a quantity of the cooling water flowing in each of said passageways when a temperature of the cooling water is under a predetermined value, and wherein a connecting point between said oil cooler cooling water communicating passageway and said heater-side cooling water communicating passageway exists more upstream than a point at which said flow rate control valve is disposed on said heater-side cooling water communicating passageway.

2. The apparatus for circulating cooling water for an internal combustion engine as set forth in claim 1, wherein said flow rate control valve disposed in the radiator-side cooling water communicating passageway and said flow rate control valve disposed in the heater-side cooling water communicating passageway are thermostat or thermostat type flow rate control valves.

3. The apparatus for circulating cooling water for an internal combustion engine as set forth in claim 2, wherein said flow rate control valves are thermal-sensitive to a temperature of the cooling water to allow flowing of the cooling water in a very small amount even when the valves are in the closed state.

4. The apparatus for circulating cooling water for an internal combustion engine as set forth in claim 1 wherein the flow rate control valve disposed in the radiator-side cooling water communicating passageway has a valve opening temperature higher than that of the flow rate control valve disposed in the heater-side cooling water communicating passageway.

5. The apparatus for circulating cooling water for an internal combustion engine as set forth in claim 4, wherein a passage specified for flowing the cooling water from the heater towards the internal combustion engine body is connected with the radiator-side cooling water communicating passageway at a position downstream of a location of the flow rate control valve provided in said radiator-side cooling water communicating passageway, thereby when the flow rate control valve disposed in the heater-side cooling water communicating passageway is opened the cooling water is circulated between the heater and the internal combustion engine body through said specified passage.

* * * * *

UNITED STATES PATENT AND TRADEMARK OFFICE

CERTIFICATE OF CORRECTION

PATENT NO. : 5,970,927

DATED : October 26, 1999

INVENTOR(S) : Suzuki

It is certified that error appears in the above-identified patent and that said Letters Patent is hereby corrected as shown below:

In the Abstract

Line 6: Change "gong" to -- going --.

Line 12: Change "bypasses" to -- bypassing --.

Line 17: After "passageway" insert -- are --.

| Column | Line | |
|---|---|---|
| 1 | 16 | Change "room" to -- passenger compartment --. |
| 1 | 23 | Change "if" to -- of --. |
| 1 | 38 | Change "a start-up velocity" to "the efficiency". |
| 1 | 63 | Delete "in a cool state"; delete "being". |
| 2 | 6 | Change "much time" to -- longer --. |
| 2 | 8 | Delete "a". |
| 2 | 11 | Delete "contrived". |

UNITED STATES PATENT AND TRADEMARK OFFICE

CERTIFICATE OF CORRECTION

PATENT NO. : 5,970,927
DATED : October 26, 1999
INVENTOR(S) : Suzuki

It is certified that error appears in the above-identified patent and that said Letters Patent is hereby corrected as shown below:

| Column | Line | |
|---|---|---|
| 2 | 12 | Delete "under such circumstances". |
| 2 | 16 | Delete "even". |
| 3 | 8 | Change "be perceptive" to -- convey an accurate --. |
| 3 | 9 | Delete "of how much a"; delete "may be, i.e.,". |
| 3 | 53 | Change "of that" to -- than that --. |
| 3 | 63 | Change "stagnates" to -- pools --; change "dificult" to -- difficult --. |
| 4 | 1 | Delete "that much". |
| 4 | 18 | Change "int" to -- into --. |

UNITED STATES PATENT AND TRADEMARK OFFICE

CERTIFICATE OF CORRECTION

PATENT NO. : 5,970,927
DATED : October 26, 1999
INVENTOR(S) : Suzuki

It is certified that error appears in the above-identified patent and that said Letters Patent is hereby corrected as shown below:

| Column | Line | |
|---|---|---|
| 4 | 25 | Change "enough" to -- sufficient --; change "drive" to -- driver --. |
| 4 | 48 | After "graph" insert -- of --. |
| 4 | 64 | After "hereinafter" insert -- be --. |
| 4 | 66 | After "body" delete "3". |
| 5 | 2 | Change "evolved" to -- developed --. |
| 5 | 14 | Change "car room" to -- passenger compartment --. |
| 5 | 61 | Change "extend" to -- extends --. |
| 6 | 3 | Change "less pressure damage" to -- lesser operating pressure --. |

UNITED STATES PATENT AND TRADEMARK OFFICE

CERTIFICATE OF CORRECTION

PATENT NO. : 5,970,927
DATED : October 26, 1999
INVENTOR(S) : Suzuki

It is certified that error appears in the above-identified patent and that said Letters Patent is hereby corrected as shown below:

| Column | Line | |
|---|---|---|
| 6 | 5 | After "be" insert -- a --. |
| 6 | 37 | After "completely" insert -- stop --; change "flow" to -- flowing --. |
| 6 | 43 | Delete ", it can be said,". |
| 7 | 47 | Before "thereafter" insert -- and --. |
| 7 | 54 | Delete "to the engine body". |
| 7 | 55 | Delete "communicating passageway **14**". |
| 8 | 25 | Change "opened" to -- closed --. |
| 8 | 26 | Delete "and comes into the blocked state". |

UNITED STATES PATENT AND TRADEMARK OFFICE

CERTIFICATE OF CORRECTION

PATENT NO. : 5,970,927

DATED : October 26, 1999

INVENTOR(S) : Suzuki

It is certified that error appears in the above-identified patent and that said Letters Patent is hereby corrected as shown below:

| Column | Line | |
|---|---|---|
| 8 | 35 | Change "stagnates" to -- pools --. |
| 8 | 41 | Change "velocity" to -- efficiency --. |
| 8 | 60 | Change "fooling" to -- cooling --. |
| 9 | 32 | Change "stream" to -- upstream --. |

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*